US009314406B2

(12) United States Patent
Hironaga et al.

(10) Patent No.: US 9,314,406 B2
(45) Date of Patent: Apr. 19, 2016

(54) MEDICINE SUPPLY APPARATUS

(71) Applicant: Takazono Technology Incorporated, Osaka (JP)

(72) Inventors: Masayuki Hironaga, Osaka (JP); Yu Kageyama, Osaka (JP); Naoya Sugimoto, Osaka (JP)

(73) Assignee: Takazono Technology Incorporated, Osaka (JP)

( * ) Notice: Subject to any disclaimer, the term of this patent is extended or adjusted under 35 U.S.C. 154(b) by 0 days.

(21) Appl. No.: 14/925,642

(22) Filed: Oct. 28, 2015

(65) Prior Publication Data

US 2016/0045397 A1 Feb. 18, 2016

Related U.S. Application Data

(63) Continuation of application No. 14/361,239, filed as application No. PCT/JP2012/080812 on Nov. 29, 2012.

(30) Foreign Application Priority Data

Dec. 1, 2011 (JP) ..... 2011-263588

(51) Int. Cl.
*B65D 83/04* (2006.01)
*A61J 7/00* (2006.01)

(52) U.S. Cl.
CPC ..... *A61J 7/0007* (2013.01); *B65D 83/04* (2013.01)

(58) Field of Classification Search
CPC ..... A61J 1/03; B65D 83/0445; B65D 83/049
USPC ..... 221/154, 263, 265, 289, 292, 293, 295, 221/301; 53/244, 255, 260
See application file for complete search history.

(56) References Cited

U.S. PATENT DOCUMENTS 3,545,164 A * 12/1970 Middleton ..... B65B 5/103 221/156
4,693,057 A * 9/1987 Rittinger ..... B65B 9/045 53/247
6,581,356 B2 * 6/2003 Kim ..... B65B 5/103 221/119
6,779,663 B1 * 8/2004 Pocsi ..... A61J 1/03 141/242
7,726,095 B2 * 6/2010 Yuyama ..... B65B 5/103 221/253

(Continued)

FOREIGN PATENT DOCUMENTS

CN 101842289 A 9/2010
EP 2216249 A1 8/2010

(Continued)

*Primary Examiner* — Patrick Mackey
(74) *Attorney, Agent, or Firm* — The Webb Law Firm

(57) ABSTRACT

A tablet supplying portion of a medicine supply apparatus includes a tablet supplying portion body including a supply cell, a bottom plate, and a bottom plate supporting member. A lower opening portion of the supply cell is opened and closed by the bottom plate. The bottom plate supporting member can restrict a pivotal movement of the bottom plate. The tablet supplying portion body and the bottom plate supporting member are relatively movable in a horizontal direction. The bottom plate pivotally moves between a state where the lower opening portion is blocked from opening and an opened state, along with this relative movement. In a state where the bottom plate closes the lower opening portion, at least part of an upper surface of the bottom plate is located higher, whereas a lower surface in a periphery of the lower opening portion is located lower.

6 Claims, 10 Drawing Sheets

(56) References Cited

U.S. PATENT DOCUMENTS

| | | | | |
|---|---|---|---|---|
| 8,209,942 | B2 * | 7/2012 | Kodama | B65B 5/103 221/263 |
| 2004/0074916 | A1 * | 4/2004 | Priebe | A61J 7/02 221/289 |
| 2008/0314002 | A1 | 12/2008 | Yuyama et al. | |
| 2010/0018986 | A1 * | 1/2010 | Kodama | B65B 5/103 221/8 |
| 2010/0107555 | A1 * | 5/2010 | Yuyama | B65B 9/08 53/131.2 |
| 2010/0147735 | A1 * | 6/2010 | Musgray | A61J 7/04 206/538 |
| 2010/0237089 | A1 * | 9/2010 | Kodama | B65B 5/103 221/97 |
| 2011/0154780 | A1 | 6/2011 | Kodama et al. | |
| 2011/0197547 | A1 | 8/2011 | Yuyama et al. | |

FOREIGN PATENT DOCUMENTS

| | | | |
|---|---|---|---|
| JP | 03200502 | | 9/1991 |
| JP | 571101 | U | 9/1993 |
| JP | 2004113506 | A | 4/2004 |
| JP | 2007008586 | A | 1/2007 |
| JP | 2008272461 | A | 11/2008 |
| JP | 201018335 | A | 1/2010 |
| JP | 201083573 | A | 4/2010 |
| WO | 2009057683 | A1 | 5/2009 |
| WO | 2010038377 | A1 | 4/2010 |

* cited by examiner

MEDICINE SUPPLY APPARATUS

CROSS REFERENCE TO RELATED APPLICATIONS

This application is a continuation application of U.S. application Ser. No. 14/361,239, filed on May 28, 2014, which is the U.S. national phase of International Application No. PCT/JP2012/080812, filed on Nov. 29, 2012, and claims priority to Japanese Patent Application No. 2011-263588, filed on Dec. 1, 2011, the disclosures of which are each hereby incorporated in their entirety by reference.

FIELD

The present invention relates to a medicine supply apparatus for dividing, into small portions, tablets or medicines having a dosage form similar to a tablet form (hereinafter, "tablets and similar medicines") and supplying the divided tablets or such medicines.

BACKGROUND

A medicine dispensing and packing apparatus or the like includes a medicine supply apparatus for dividing, into small portions, tablets and similar medicines and supplying the divided tablets or such medicines (see, for example, Patent Literature 1).

As illustrated in FIG. 10A, a medicine supply apparatus described in Patent Literature 1 includes an upper tablet cassette 101, a lower tablet cassette 104 located below the upper tablet cassette 101, and a movable plate 107 and a fixed plate 108 located below the lower tablet cassette 104.

The upper tablet cassette 101 includes a plurality of distribution cells 102 arranged in the left-right direction and the depth direction (not shown) of FIG. 10A. The upper tablet cassette 101 includes a shutter 103 that opens and closes lower opening portions of the distribution cells 102.

Further, the lower tablet cassette 104 includes supply cells 105 corresponding to the upper tablet cassette 101. The lower tablet cassette 104 includes tabular bottom plates 106 that respectively open and close lower opening portions of the supply cells 105. The bottom plates 106 are each pivotally movably supported by the lower tablet cassette 104 by means of a shaft. As illustrated in FIG. 10A, the bottom plates 106 are supported from below by the movable plate 107 and the fixed plate 108. With this structure, the bottom plates 106 respectively cover the lower opening portions of the supply cells 105. In this state, tablets can be temporarily housed in the supply cells 105.

An operator who operates the medicine dispensing and packing apparatus or the like, first manually sprinkles tablets in a necessary amount according to a prescription, over the distribution cells 102 of the upper tablet cassette 101. Then, the operator actuates the medicine supply apparatus. Thereby, the shutter 103 of the upper tablet cassette 101 is opened. Consequently, the tablets drop onto the supply cells 105 of the lower tablet cassette 104.

Then, as illustrated in FIG. 10B, the movable plate 107 is moved in the horizontal direction (the right direction of FIG. 10B) with respect to the lower tablet cassette 104. Thereby, the support of each bottom plate 106 from below is cancelled, so that the bottom plate 106 comes into an opened state. Consequently, the tablets drop from the supply cells 105 onto a hopper 109. The dropped tablets are packed for each small portion using packing paper by a dispensing and packing mechanism (not shown).

CITATION LIST

Patent Literature

Patent Literature 1: Japanese Utility Model Laid-Open No. Hei-5-71101

SUMMARY

Technical Problem

As described above, each bottom plate 106 is supported from below by the movable plate 107 and the fixed plate 108. However, the positional relationship between: the lower tablet cassette 104; and the movable plate 107 and the fixed plate 108 may vary depending on the dimension accuracy and assembly accuracy of individual parts constituting the medicine supply apparatus. Hence, as illustrated in FIG. 10C, in spite of the fact that the bottom plate 106 is supported from below by the movable plate 107 and the fixed plate 108, the bottom plate 106 hangs loosely downward. As a result, a gap Z may exist between the supply cell 105 and the bottom plate 106.

Here, thin tablets (for example, a thickness of about 1 mm) are discussed. In the case where the thin tablets are supplied, if the gap Z exists between the supply cell 105 and the bottom plate 106 as illustrated in FIG. 10C, the tablets pass through the gap Z to thereby drop out of the supply cell 105 having the lower opening portion that should be covered by the bottom plate 106. Because this drop is not intended, there may occur disadvantages that the tablets remain inside of the medicine dispensing and packing apparatus or the like and that the tablets are dispensed and packed in a different amount (for example, an amount larger or smaller than a prescription). It is however unfavorable to enhance the dimension accuracy and assembly accuracy of the parts in order to eliminate the gap Z and thus suppress these advantages, because manufacturing costs of the medicine supply apparatus increase.

In view of the above, the present invention has an object to provide a medicine supply apparatus that can suppress an unintentional drop of tablets and similar medicines while suppressing an increase in manufacturing costs.

Solution to Problem

The present invention provides a medicine supply apparatus for dividing, into small portions, tablets or medicines having a dosage form similar to a tablet form and supplying the divided tablets or the medicines, the medicine supply apparatus including a tablet supplying portion that temporarily houses the tablets or the medicines. The tablet supplying portion includes a tablet supplying portion body, a bottom plate, and a bottom plate supporting member. The tablet supplying portion body includes a supply cell. The supply cell includes an upper opening portion opened upward and a lower opening portion opened downward. A tablet housing space is formed between the upper opening portion and the lower opening portion. The bottom plate is provided so as to correspond to the supply cell, and includes a bottom plate upper surface, a first end portion, and a second end portion. The first end portion of the bottom plate is attached to the tablet supplying portion body such that the lower opening portion is opened and closed by a pivotal movement of the second end portion of the bottom plate. The bottom plate supporting member supports the bottom plate from below to thereby make a pivotal movement of the bottom plate restrictable, and is relatively movable in a horizontal direction with respect to the tablet supplying portion body. The bottom plate pivotally moves between a state where the lower opening portion is blocked from opening and an opened state, along with the relative movement in the horizontal direction. In a state where the bottom plate closes the lower opening portion, at least part of the bottom plate upper surface is located higher, whereas a lower surface in a periphery of the lower opening portion is located lower.

Further, the bottom plate may include a bottom plate lower surface. The bottom plate supporting member may be provided at a position spaced apart downward from the bottom plate lower surface. A distance between: a highest portion of the bottom plate upper surface in the state where the bottom plate closes the lower opening portion; and the lower surface in the periphery of the lower opening portion may be equal to or more than a distance between the bottom plate lower surface and an upper surface of the bottom plate supporting member in such a closed state.

Further, the bottom plate may include a portion located inside of the tablet housing space in the state where the bottom plate closes the lower opening portion.

Further, the bottom plate may include a base portion and a protruding portion that protrudes upward from the base portion. The base portion may be located outside of the tablet housing space in the state where the bottom plate closes the lower opening portion. The protruding portion may be located inside of the tablet housing space in such a closed state.

Further, the protruding portion may be provided so as to extend from the first end portion to the second end portion of the bottom plate in the horizontal direction.

Further, an upper surface of the protruding portion may be inclined with respect to the base portion such that an amount of upward protrusion of the protruding portion on the second end portion side of the bottom plate in the horizontal direction is larger than an amount of upward protrusion thereof on the first end portion side thereof in the horizontal direction.

Further, the periphery of the lower opening portion of the supply cell may include an inner peripheral portion and an outer peripheral portion. A lower surface of the inner peripheral portion may be located higher than a lower surface of the outer peripheral portion. The bottom plate may be abuttable against the lower surface of the inner peripheral portion.

DESCRIPTION OF EMBODIMENTS

Now, the present invention is described by way of embodiments. Note that the dosage form of medicines as targets to be supplied by a medicine supply apparatus of the present invention is not limited to a tablet form. Various medicines having a dosage form similar to a tablet form (for example, a capsule form), which can be pinched by an operator and manually sprinkled over an upper tablet cassette, can be applied as the targets to be supplied. Note that, for convenience sake, the targets to be supplied are assumed as tablets in the following description.

Figure 1:
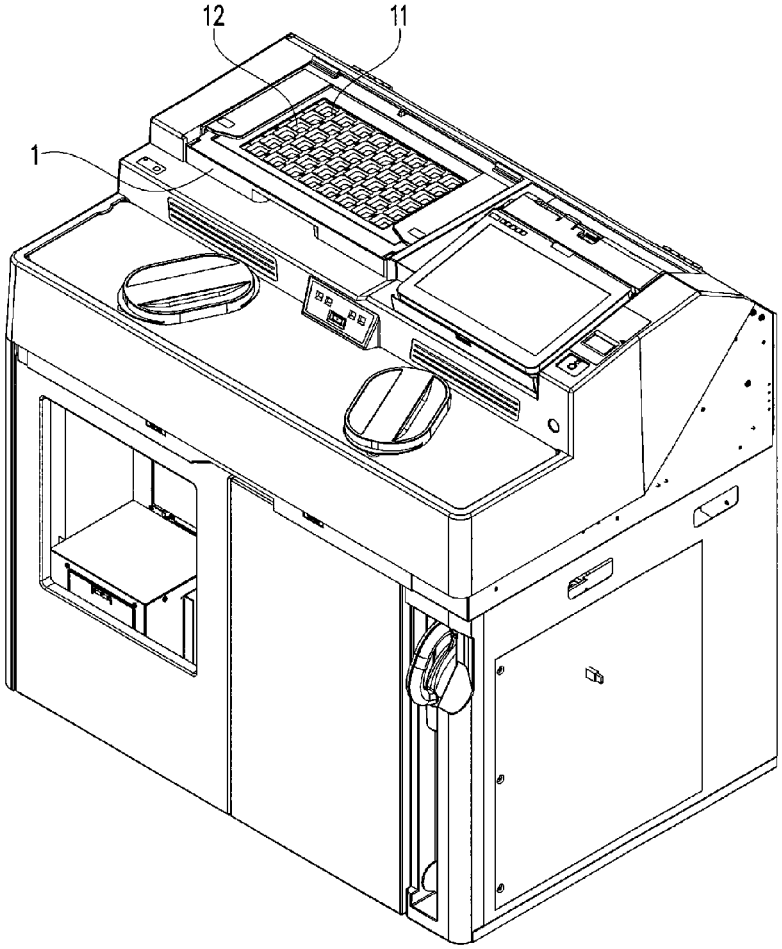
FIG. 1 is a schematic view illustrating an external appearance of a medicine dispensing and packing apparatus including a tablet supplying portion of the present embodiment.
Figure 2:
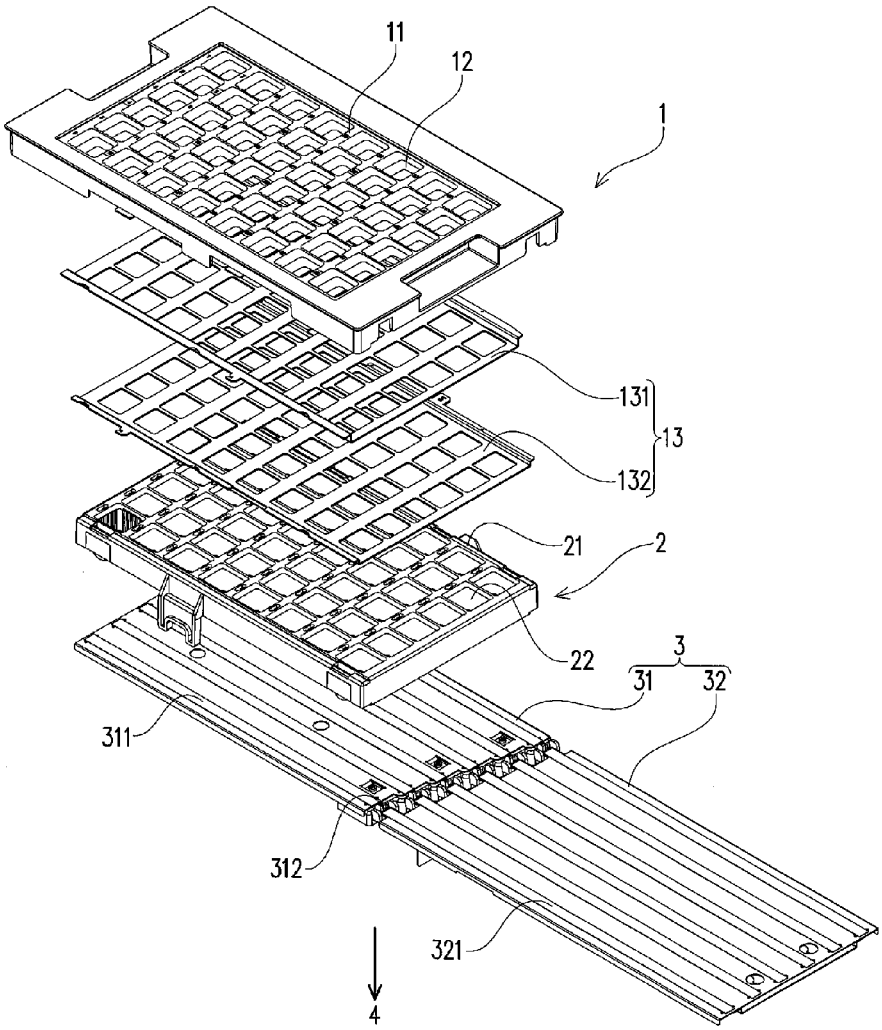
FIG. 2 is an exploded schematic view illustrating the tablet supplying portion of the present embodiment.

For example, as illustrated in FIG. 1, a medicine supply apparatus of the present embodiment is built in a medicine dispensing and packing apparatus that can dispense and pack powder and tablets. The medicine supply apparatus is used to divide the tablets into small portions and supply the divided tablets. As illustrated in FIG. 2, the medicine supply apparatus includes an upper tablet cassette 1, a lower tablet cassette 2 as a tablet supplying portion located below the upper tablet cassette 1, and a support plate 3 as a bottom plate supporting member located below the lower tablet cassette 2.

Figure 5A:
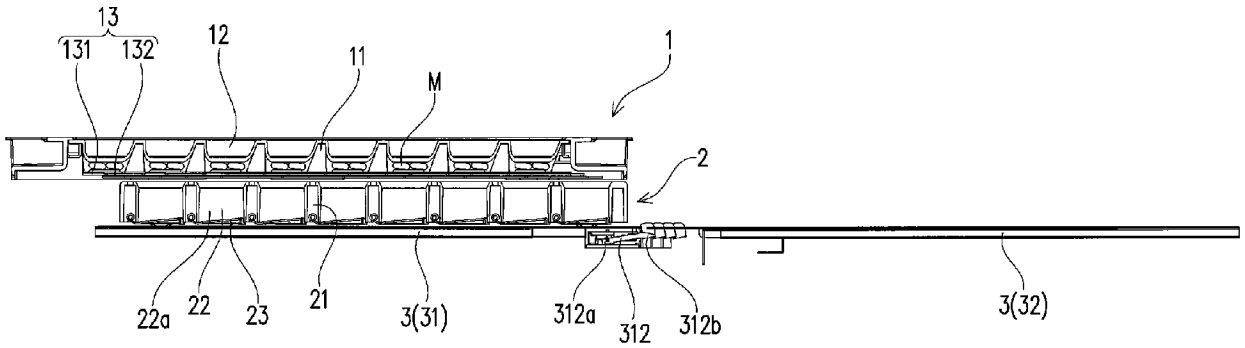
FIG. 5A is a vertical cross-sectional view illustrating the tablet supplying portion of the present embodiment, at an initial position.
Figure 5B:
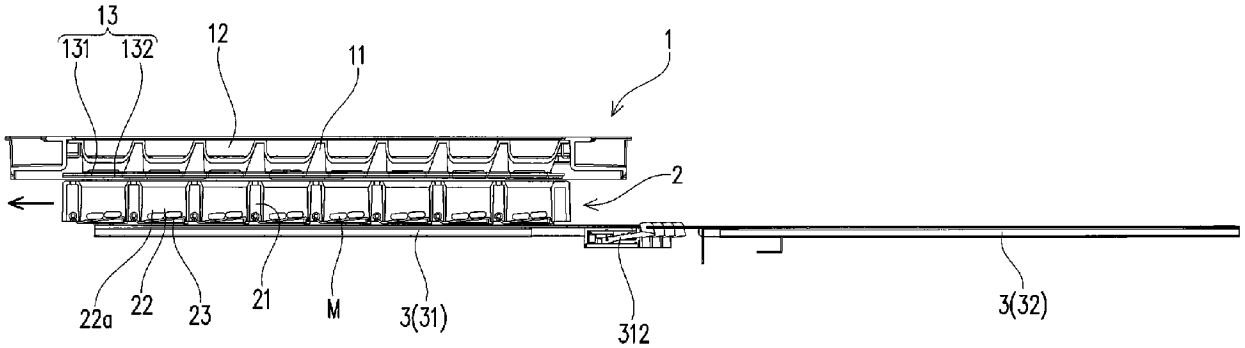
FIG. 5B is a vertical cross-sectional view illustrating the tablet supplying portion of the present embodiment, at a position when tablets are dropped from an upper tablet cassette to the lower tablet cassette.

The upper tablet cassette 1 includes a body 11 in which a plurality of distribution cells 12 arranged in a matrix in the left-right direction and the depth direction are formed. An upper opening portion and a lower opening portion that are substantially square in planar view and bottom surface view are opened in each distribution cell 12. The upper tablet cassette 1 does not move with respect to the medicine dispensing and packing apparatus at the time of tablet supply. Then, the upper tablet cassette 1 includes a shutter 13 that opens and closes the lower opening portions of the distribution cells 12. As illustrated in FIG. 2, the shutter 13 includes an upper shutter 131 and a lower shutter 132, and can be opened by sliding the shutters 131 and 132 in the horizontal direction. In the case where the shutter 13 is closed, as illustrated in FIG. 5A, tablets M can be temporarily held in the distribution cells 12. Then, when the shutter 13 is opened, as illustrated in FIG. 5B, the tablets M held in the distribution cells 12 can be dropped onto the lower tablet cassette 2.

The lower tablet cassette 2 includes a body 21 in which a plurality of supply cells 22 that are arranged in a matrix correspondingly to the upper tablet cassette 1 are formed. Similarly to the distribution cells 12, an upper opening portion and a lower opening portion that are substantially square in planar view and bottom surface view are opened in each supply cell 22, and a tablet housing space 22*a* is formed between the upper opening portion and the lower opening portion. That is, the tablet housing space 22*a* is a region above a virtual plane defined by a lower surface 22*b* (see FIG. 7A) in the periphery of the lower opening portion, in the space inside of the supply cell 22. As illustrated in FIG. 5 and FIG. 6, the lower tablet cassette 2 is horizontally movable in the longitudinal direction (the left-right direction of FIG. 5 and FIG. 6) with respect to the upper tablet cassette 1. Note that it is sufficient that the lower tablet cassette 2 be relatively movable with respect to the support plate 3, and it is possible to adopt a configuration in which the lower tablet cassette 2 is fixed to the upper tablet cassette 1.

Figure 3:
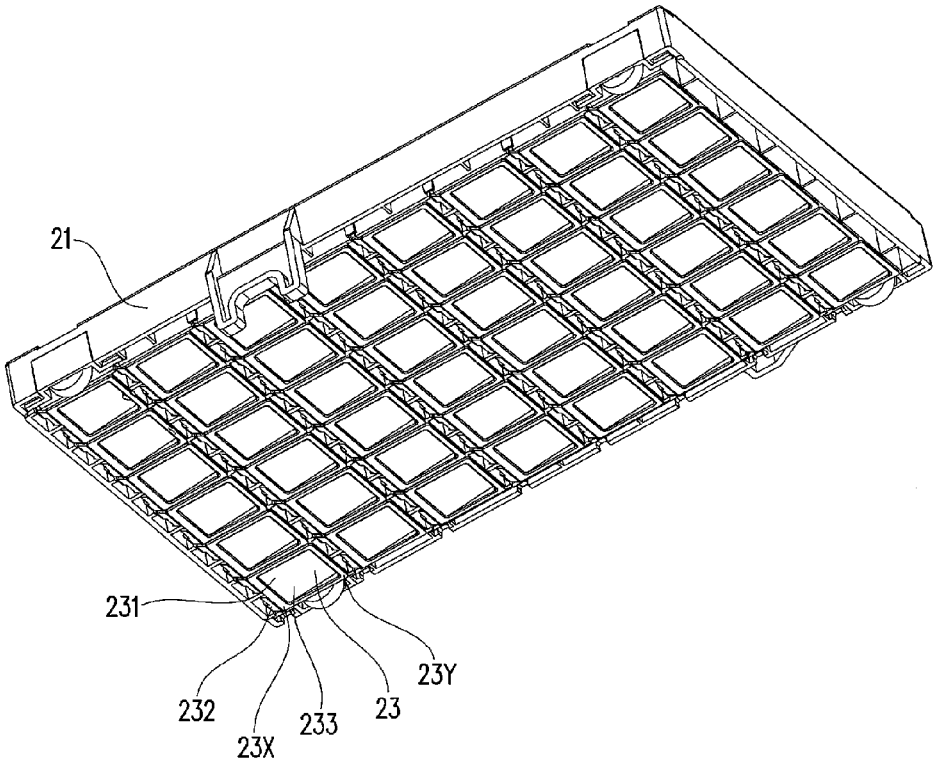
FIG. 3 is a schematic view illustrating a lower tablet cassette of the present embodiment, which is observed from a bottom surface side thereof.

As illustrated in FIG. 3, the lower tablet cassette 2 includes a plurality of bottom plates 23 that respectively open and close the lower opening portions of the supply cells 22 (note that, although the bottom plates 23 are virtually in a closed state in FIG. 3, the bottom plates 23 are actually in an opened state when being not supported from below by the support plate 3). The bottom plates 23 are provided to respectively close by covering the lower opening portions of the supply cells 22. Each bottom plate 23 is supported by the body 21 by means of a shaft so as to be pivotally movable in the top-bottom direction (about a horizontal axis). In the case where the bottom plate 23 is at the upper end of its pivotally movable range, the bottom plate 23 closes the lower opening portion. The bottom plate 23 is supported in a first end portion 23X thereof in the horizontal direction (the left end portion in FIG. 3 (the right end portion in FIG. 3 is referred to as "second end portion 23Y")). With this configuration, the bottom plate 23 is pivotally movable with respect to the body 21, about the first end portion 23X at which the bottom plate 23 is supported. Note that the bottom plate 23 is not urged by a spring or the like. Hence, the bottom plate 23 opens by a pivotal movement due to its own weight.

As illustrated in FIG. 5 and FIG. 6, the bottom plates 23 are supported from below by the support plate 3 located below the lower tablet cassette 2. With this configuration, the bottom plates 23 are restricted from pivotally moving in the top-bottom direction (about the horizontal axes), and are blocked from opening. In this state, each supply cell 22 and each bottom plate 23 are in proximity to each other with a gap existing therebetween, the gap being small enough not to allow the tablets M to pass therethrough. Then, the tablets M that are dropped from the distribution cells 12 of the upper tablet cassette 1 by opening the shutter 13 of the upper tablet cassette 1 can be temporarily housed in the respective tablet housing spaces 22*a* of the supply cells 22.

Figure 4:
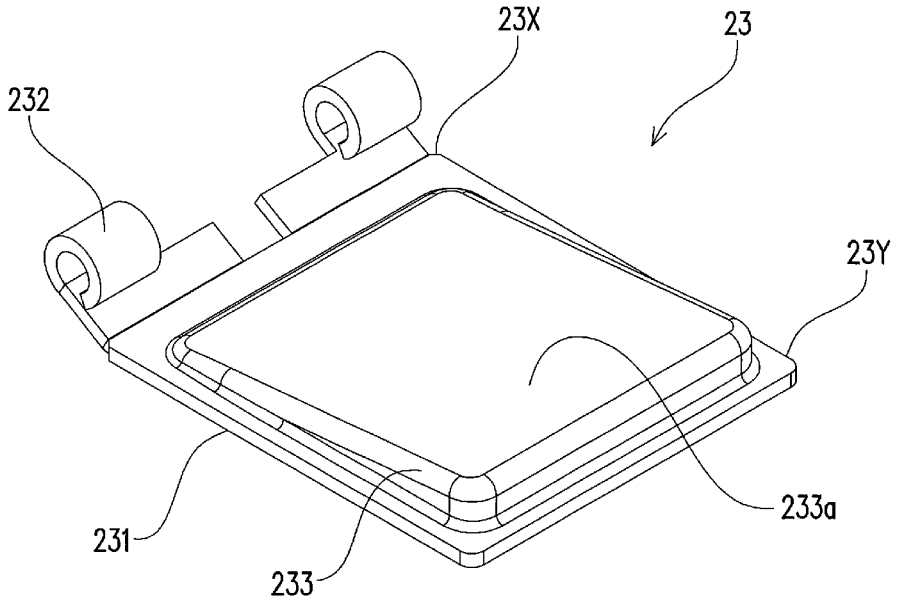
FIG. 4 is a schematic view illustrating a bottom plate of the present embodiment.

The bottom plate 23 has such a shape as illustrated in FIG. 4, and is integrally formed. The bottom plate 23 of the present embodiment is formed by press working of stainless steel, but various materials (such as synthetic resin) and various methods can be adopted therefor. The bottom plate 23 includes a base portion 231, a shaft supporting portion 232, and a protruding portion 233.

Figure 7A:
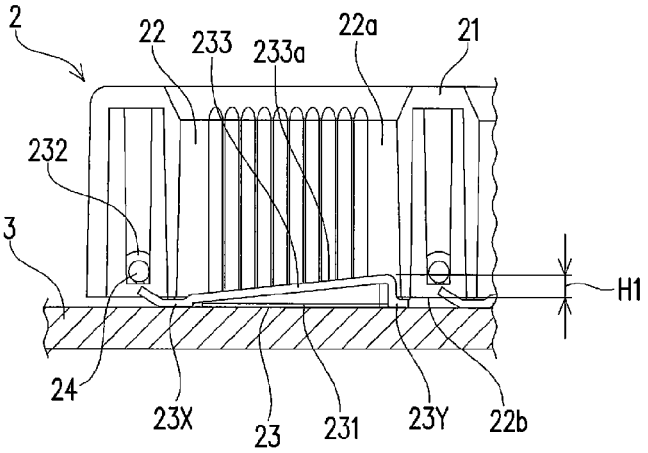
FIG. 7A is a cross-sectional view illustrating the lower tablet cassette of the present embodiment, in a virtual state where the bottom plate closes a lower opening portion.

The base portion 231 is tabular, and has an upper surface that is abuttable against the lower surface 22*b* in the periphery of the lower opening portion of the supply cell 22 (see FIG. 7A). The shaft supporting portion 232 is provided in the first end portion 23X of the bottom plate 23, and is a tubular portion through which a shaft portion 24 (see FIG. 7A to FIG. 7C) that extends in the depth direction of the lower tablet cassette 2 penetrates.

The protruding portion 233 is a portion at least part of which protrudes upward from the base portion 231 in the state where the bottom plate 23 closes the lower opening portion of the supply cell 22. That is, in such a closed state, at least part of the upper surface of the bottom plate 23 is located higher, whereas the lower surface 22*b* in the periphery of the lower opening portion is located lower. The protruding portion 233 is substantially square in planar view, which is substantially coincident with (slightly smaller than) the shape of the lower opening portion of the supply cell 22. The protruding portion 233 is provided so as to extend from the first end portion 23X to the second end portion 23Y of the bottom plate 23. Hence, generation of a gap with the bottom plate 23 can be suppressed over the entire supply cell 22.

In the present embodiment, an upper surface 233*a* of the protruding portion 233 is an inclined surface. Specifically, the protruding portion 233 is formed such that the amount of protrusion thereof on the second end portion 23Y side is larger than the amount of protrusion thereof on the first end portion 23X side, whereby the upper surface 233*a* of the protruding portion 233 has a one-way inclination with respect to the tabular base portion 231.

In this way, the bottom plate 23 includes the protruding portion 233. It is assumed here that, as virtually illustrated in FIG. 7A, the base portion 231 abuts against the lower surface 22*b* in the periphery of the lower opening portion, and closes the lower opening portion. In this case, the upper surface 233*a* of the protruding portion 233 is located higher by an amount corresponding to a height H1 illustrated in FIG. 7A than the lower surface 22*b* in the periphery of the lower opening portion of the supply cell 22. In other words, the protruding portion 233 enters the tablet housing space 22*a* by the amount corresponding to the height H1.

In this way, the protruding portion 233 enters the tablet housing space 22*a*. Hence, even if the bottom plate 23 hangs loosely to some degree on the second end portion 23Y side (distal end side in the pivotal movement) (see FIG. 7C), the positional relationship in the top-bottom direction between the bottom plate 23 and the support plate 3 maintains the state where part of the protruding portion 233 enters the tablet housing space 22*a*, until the height of this loose hanging reaches the height H1. Hence, a gap through which the tablets M unintentionally pass is less likely to be generated between the supply cell 22 and the bottom plate 23.

In particular, the second end portion 23Y that is the distal end of the bottom plate 23 in the pivotal movement is farthest from the first end portion 23X at which the bottom plate 23 is supported by means of the shaft. Accordingly, in the case where a gap is generated between the supply cell 22 and the bottom plate 23, the gap is largest in the second end portion 23Y due to the loose hanging. Hence, in order to prevent the tablets M from passing through the gap, it is effective to provide the protruding portion 233 particularly at a position closer to the second end portion 23Y or provide the protruding portion 233 having a larger amount of protrusion than those at other positions, at a position closer to the second end portion 23Y, in the bottom plate 23.

Figure 7B:
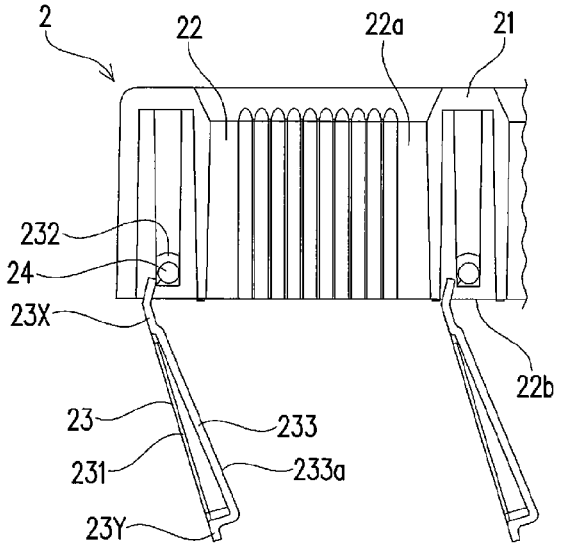
FIG. 7B is a vertical cross-sectional view illustrating the tablet supplying portion of the present embodiment, in a state where the lower opening portion is opened.

Further, the upper surface 233*a* of the protruding portion 233 is an inclined surface. Hence, the amount of protrusion of the protruding portion 233 from the base portion 231 in a portion closer to the first end portion 23X is smaller than the amount of protrusion thereof from the base portion 231 in other portions. Hence, compared with a protruding portion 233 whose amount of protrusion from the base portion 231 is equal over its entire surface, the bottom plate 23 is less likely to be caught on the periphery of the lower opening portion of the supply cell 22 along with a pivotal movement of the bottom plate 23. Hence, the bottom plate 23 smoothly pivotally moves. Furthermore, when the bottom plate 23 is in an opened state as illustrated in FIG. 7B, the tablets M can be suppressed from being caught on the protruding portion 233 and remaining thereon.

Note that the positional relationship in the top-bottom direction between the bottom plate 23 and the support plate 3 for enabling the protruding portion 233 to enter the tablet housing space 22*a* as described above is the following positional relationship. That is, the distance in the top-bottom direction between: the highest portion of the upper surface 233*a* of the protruding portion 233 in the state where the bottom plate 23 closes the lower opening portion of the supply cell 22; and the lower surface 22*b* in the periphery of the lower opening portion is equal to or more than the distance in the top-bottom direction between the lower surface of the bottom plate 23 and the upper surface of the support plate 3 in such a closed state.

Next, as illustrated in FIG. 2, the support plate 3 includes a movable plate 31 and a fixed plate 32. The fixed plate 32 is immovable. On the other hand, the movable plate 31 is movable in the longitudinal direction (horizontal direction). With this configuration, the movable plate 31 is movable with respect to the lower tablet cassette 2. The plates 31 and 32 are at positions spaced apart from the lower surfaces of the bottom plates 23. It is however sufficient that the support plate 3 be relatively movable with respect to the lower tablet cassette 2. Accordingly, for example, it is possible to adopt a configuration in which both the plates 31 and 32 are movable. Note that the "positions spaced apart" at which the plates 31 and 32 are provided refer to positions determined by placing a distance such that the relative movement with respect to the lower tablet cassette 2 is not blocked. As described above, each bottom plate 23 is not urged by a spring or the like, and hangs loosely due to its own weight. Hence, the second end portion 23Y of each bottom plate 23 abuts against the respective upper surfaces (specifically, sliders 311 and 321) of the plates 31 and 32. That is, strictly speaking, even in the case where the bottom plates 23 are supported from below by the support plate 3, because the base portion 231 of each bottom plate 23 does not abut against the lower surface 22*b* at the opening edge of each supply cell 22, the lower opening portion is not closed.

Along with the movement of the movable plate 31 in the horizontal direction, each bottom plate 23 pivotally moves in the top-bottom direction (about the horizontal axis) between: the state where the bottom plate 23 is supported from below by the support plate 3 and are blocked from opening (see FIG. 7A); and the opened state where the support is cancelled (see FIG. 7B). Note that a tablet hopper 4 is provided below between the movable plate 31 and the fixed plate 32 (see FIG. 6B), and the dropped tablets M can be fed to a dispensing and packing mechanism (not shown) via the tablet hopper 4.

A step is provided between the movable plate 31 and the fixed plate 32. Specifically, the upper surface of the fixed plate 32 is located lower than the upper surface of the movable plate 31. As described above, each bottom plate 23 is supported in the first end portion 23X thereof by the body 21 of the lower tablet cassette 2. Hence, the second end portion 23Y of the bottom plate 23 hangs loosely downward in a free state due to its own weight. Hence, when the lower tablet cassette 2 is moved rightward from the state illustrated in FIG. 5B to the state illustrated in FIG. 6A, if the upper surface of the fixed plate 32 is located higher than the upper surface of the movable plate 31, the second end portions 23Y of the bottom plates 23 may be caught on a left end portion (in FIG. 5B and FIG. 6A) of the fixed plate 32, and the movement of the lower tablet cassette 2 may be blocked. Hence, the upper surface of the fixed plate 32 is located lower than the upper surface of the movable plate 31.

As illustrated in FIG. 2, the upper surfaces of the movable plate 31 and the fixed plate 32 are respectively provided with the plurality of resin sliders 311 and 321 that extend in parallel along the longitudinal direction. The intervals in the depth direction of the sliders 311 and 321 of the plates 31 and 32 are coincident with the intervals in the depth direction of the supply cells 22 of the lower tablet cassette 2. When the lower tablet cassette 2 is (relatively) moved with respect to the support plate 3, the second end portions 23Y of the bottom plates 23 abut against the sliders 311 and 321. This can reduce friction generated between the support plate 3 and the bottom plates 23. Accordingly, generation of metal powder due to the friction can be suppressed.

Figure 6A:
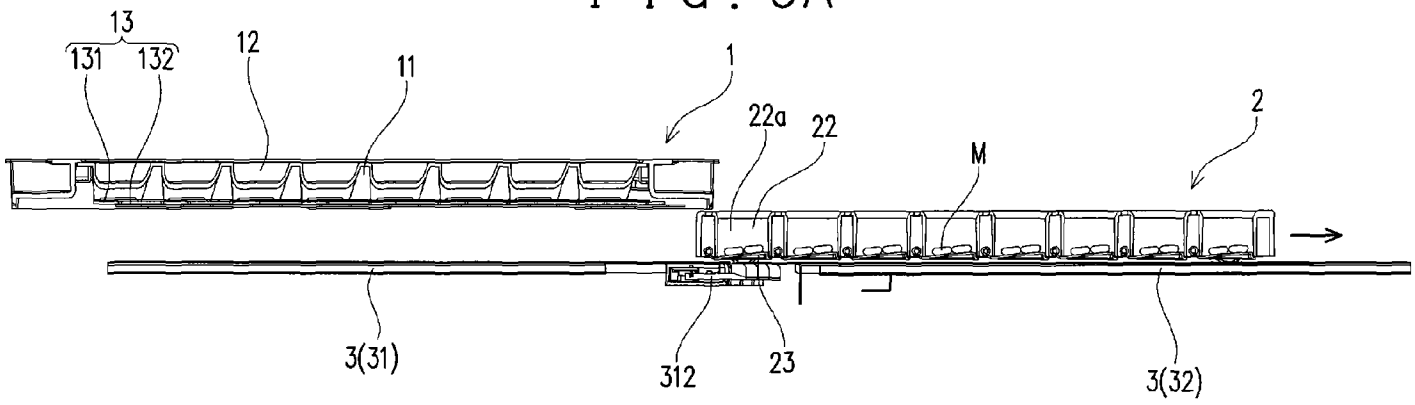
FIG. 6A is a vertical cross-sectional view illustrating the tablet supplying portion of the present embodiment, at a position immediately before start of supply.

Further, the movable plate 31 and the fixed plate 32 are provided with a gap existing therebetween in the longitudinal direction. In order to fill this gap, the movable plate 31 includes a support arm 312 in a portion closer to the right end thereof in FIG. 5A. The support arm 312 is made of resin, and has: a proximal end portion 312*a* located on the movable plate 31; and a distal end portion 312*b* located in the gap between the movable plate 31 and the fixed plate 32, as illustrated in FIG. 5A. The support arm 312 is urged by a spring, whereby the distal end portion 312*b* thereof protrudes upward. For example, as illustrated in FIG. 6A, the support arm 312 supports from below each bottom plate 23 located above the gap between the movable plate 31 and the fixed plate 32, to thereby prevent the bottom plate 23 from coming into an opened state.

Next, how to use the medicine supply apparatus of the present embodiment is described. Note that manual sprinkling work of the tablets M is manually performed by the operator. The other work is automatically performed by the medicine supply apparatus (medicine dispensing and packing apparatus). FIG. 5A illustrates the initial positions of parts constituting the medicine supply apparatus. At this time, the shutter 13 of the upper tablet cassette 1 is closed. The operator who operates the medicine dispensing and packing apparatus first manually sprinkles the tablets M in a necessary amount according to a prescription, over the distribution cells 12 of the upper tablet cassette 1.

Then, as illustrated in FIG. 5B, the lower tablet cassette 2 is moved leftward of FIG. 5B such that the supply cells 22 of the lower tablet cassette 2 respectively coincide with the distribution cells 12 of the upper tablet cassette 1 in the top-bottom direction. In this state, when the shutter 13 of the upper tablet cassette 1 is opened, the tablets M drop from the upper tablet cassette 1 to the lower tablet cassette 2.

Figure 6B:
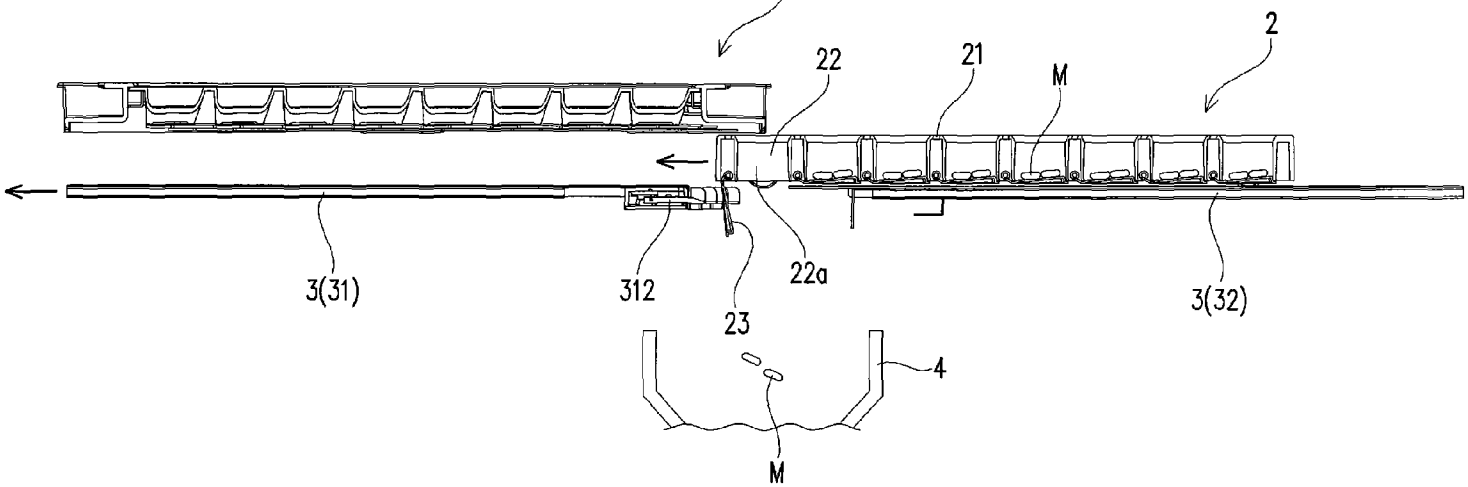
FIG. 6B is a vertical cross-sectional view illustrating the tablet supplying portion of the present embodiment, at a position during supply.

Subsequently, the lower tablet cassette 2 is moved rightward to come into the state illustrated in FIG. 6A. After that, as illustrated in FIG. 6B, the lower tablet cassette 2 and the movable plate 31 are horizontally moved leftward. Consequently, each bottom plate 23 whose support from below by the movable plate 31 is cancelled (in the example illustrated in FIG. 6B, the bottom plate 23 of the leftmost supply cell 22) pivotally moves to come into an opened state. As a result, the tablets M drop from the supply cell 22 in the opened state into the tablet hopper 4 provided below the support plate 3. Then, the tablets M that have dropped into the tablet hopper 4 are packed using packing paper by the dispensing and packing mechanism (not shown) located below the medicine supply apparatus.

Here, the leftward horizontal movement of the movable plate 31, which is illustrated in FIG. 6B, is intermittently made at a movement distance corresponding to the intervals in the left-right direction of the supply cells 22 of the lower tablet cassette 2. Note that, as illustrated in FIG. 2, the right end of the movable plate 31 and the left end of the fixed plate 32 are located more rightward toward the far side. That is, the end face shapes of the plates 31 and 32 on the opposing side are "stepwise". With this configuration, the supply cells 22 are opened one by one, and the tablets M drop therefrom, along with the intermittent movement of the movable plate 31.

Figure 7C:
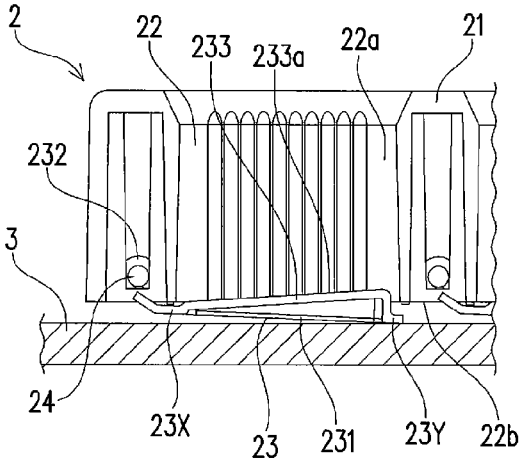
FIG. 7C is a vertical cross-sectional view illustrating the tablet supplying portion of the present embodiment, in a state where the bottom plate is misaligned downward.

As described above, in the state where each bottom plate 23 is blocked from opening, as illustrated in FIG. 7A and FIG. 7C, the protruding portion 233 of the bottom plate 23 is located higher than the lower surface 22*b* in the periphery of the lower opening portion of the supply cell 22. Hence, the protrusion height (the height H1 illustrated in FIG. 7A) of the protruding portion 233 from the base portion 231 can serve as an absorption allowance for absorbing a positional error in the top-bottom direction due to the gap between the support plate 3 and the lower tablet cassette 2. Hence, within the range of the absorption allowance, the second end portion 23Y of the bottom plate 23 is allowed to hang loosely as illustrated in FIG. 7C. Accordingly, in the state where the protruding portion 233 is blocked from releasing, a gap through which the tablets M unintentionally pass is less likely to be generated between the supply cell 22 and the bottom plate 23.

Then, as described above, the upper surface of the fixed plate 32 is provided lower than the upper surface of the movable plate 31. Hence, in the case where the lower tablet cassette 2 is located above the fixed plate 32 as illustrated in FIG. 6A and FIG. 6B, the gap between the supply cell 22 and the bottom plate 23 becomes wider than that in the case where the lower tablet cassette 2 is located above the movable plate 31. In the present embodiment, gap generation can be effectively suppressed even in such a case, because the protruding portion 233 of the bottom plate 23 is located higher than the lower surface 22*b* in the periphery of the lower opening portion of the supply cell 22.

In this way, in the present embodiment, even in the case where thin tablets M are supplied, a gap large enough to allow the tablets M to pass therethrough can be suppressed from being generated between the supply cell 22 and the bottom plate 23. Accordingly, disadvantages that the dropped tablets M remain inside of the medicine dispensing and packing apparatus or the like and that the tablets M are dispensed and packed at a different amount (for example, an amount larger or smaller than a prescription) can be made less likely to occur. Then, in order to suppress generation of a gap large enough to allow the tablets M to pass therethrough, it is not necessary to specially enhance the dimension accuracy and assembly accuracy of individual parts constituting the medicine supply apparatus. Hence, it is possible to produce sufficient effects while suppressing an increase in manufacturing costs of the medicine supply apparatus.

Figure 8A:
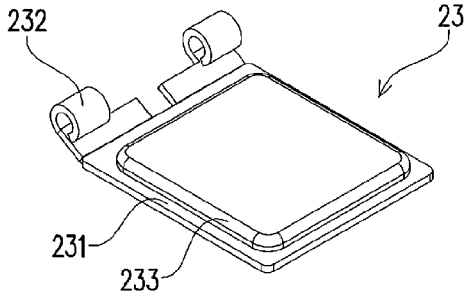
FIG. 8A is a perspective view illustrating another embodiment of the bottom plate.
Figure 8B:
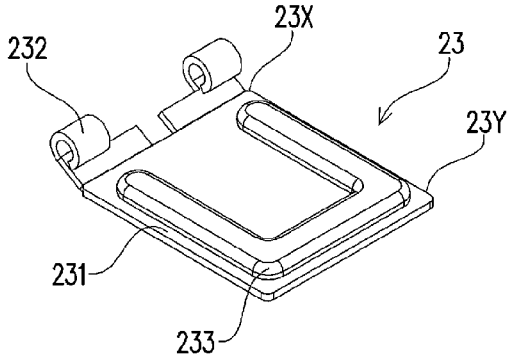
FIG. 8B is a perspective view illustrating another embodiment of the bottom plate.
Figure 8C:
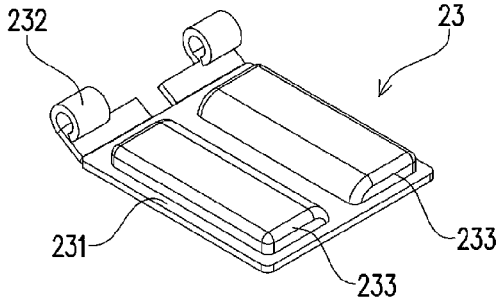
FIG. 8C is a perspective view illustrating another embodiment of the bottom plate.

Note that the shape of each bottom plate 23 is not limited to the shape in the present embodiment, and can be variously changed. Hereinafter, other embodiments of the bottom plate 23 are described. An embodiment illustrated in FIG. 8A includes a protruding portion 233 with a constant height. An embodiment illustrated in FIG. 8B includes a protruding portion 233 with a constant height that extends along three sides except the side on the first end portion 23X side of the base portion 231. Note that, although not shown, the bottom plate 23 may include a protruding portion 233 with a constant height that extends along only one side on the second end portion 23Y side of the base portion 231. An embodiment illustrated in FIG. 8C includes protruding portions 233 and 233 with a constant height that extend in parallel along two sides of the base portion 231 in the longitudinal direction of the lower tablet cassette 2.

Figure 8D:
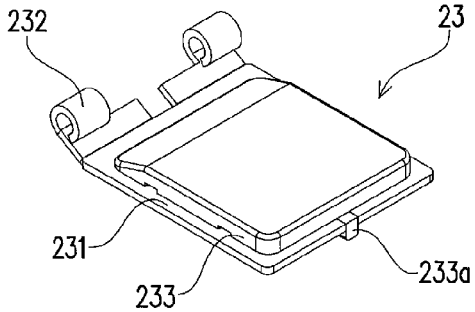
FIG. 8D is a perspective view illustrating another embodiment of the bottom plate.

Further, an embodiment illustrated in FIG. 8D has a configuration in which: a base portion 231 and a shaft supporting portion 232 are integrally formed using stainless steel or the like; and a protruding portion 233 is separately formed using resin, and is attached to the integral structure. Note that, in this embodiment, a lower surface protruding portion 233*a* that is part of the protruding portion 233 protrudes also from the lower surface of the base portion 231. The lower surface protruding portion 233*a* can reduce friction when the bottom plate 23 is moved with respect to the support plate 3. Hence, in the case of this embodiment, the sliders 311 and 321 of the support plate 3 can be omitted.

Figure 9:
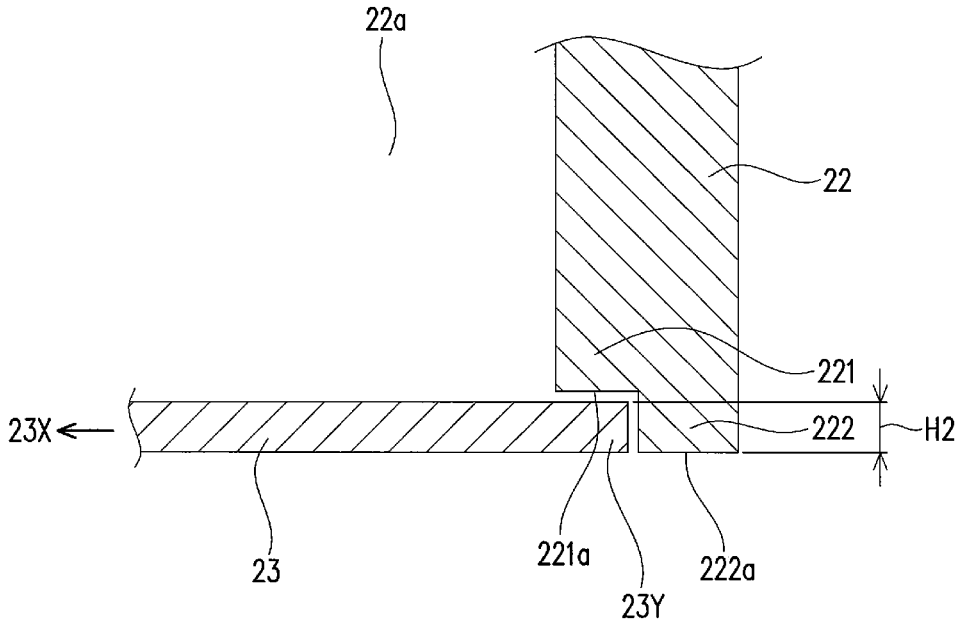
FIG. 9 is a schematic cross-sectional view illustrating another embodiment of a supply cell and the bottom plate.
Figure 10A:
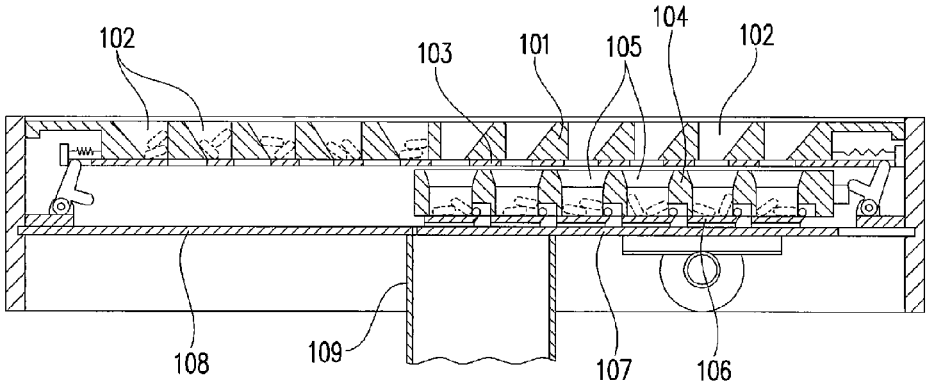
FIG. 10A is a cross-sectional view illustrating a conventional tablet supplying portion.
Figure 10B:
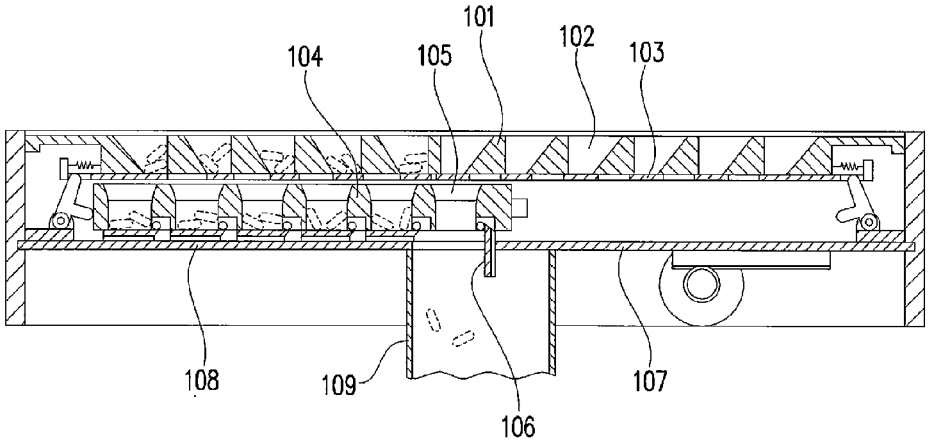
FIG. 10B is a cross-sectional view illustrating the conventional tablet supplying portion.
Figure 10C:
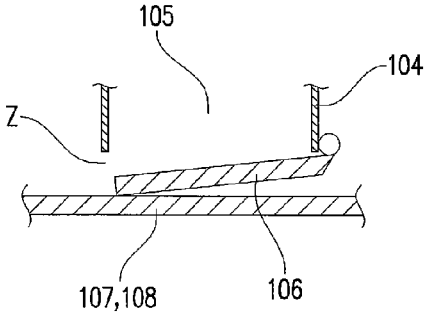
FIG. 10C is a schematic cross-sectional view illustrating a main part of the conventional tablet supplying portion.

Further, an embodiment illustrated in FIG. 9 is different from the above-mentioned embodiments. That is, each bottom plate 23 has a tabular shape similar to a conventional shape, whereas the shape of each supply cell 22 is different. Specifically, the supply cell 22 of this embodiment includes an inner peripheral portion 221 and an outer peripheral portion 222 in a peripheral portion of the lower opening portion thereof. A lower surface 221*a* of the inner peripheral portion 221 is located higher than a lower surface 222*a* of the outer peripheral portion 222. Note that, in this embodiment, the lower surface 22*b* in the periphery of the lower opening portion is coincident with the lower surface 222*a* of the outer peripheral portion 222. Then, the bottom plate 23 is abuttable against the lower surface 221*a* of the inner peripheral portion 221. That is, the inner peripheral portion 221 and the outer peripheral portion 222 form a step in the periphery of the lower opening portion of the supply cell 22. Then, in the state where the bottom plate 23 is blocked by the support plate 3 from opening, the bottom plate 23 is located on this step.

In the embodiment illustrated in FIG. 9, in the state where the bottom plate 23 is blocked from opening, the upper surface of the bottom plate 23 is located higher than the lower opening portion (the opening at the position of the lower surface 222*a* of the outer peripheral portion 222) of the supply cell 22. Hence, a height H2 from the lower surface 222*a* of the outer peripheral portion 222 to the upper surface of the bottom plate 23 can serve as an absorption allowance for absorbing a positional error in the top-bottom direction due to the gap between the support plate 3 and the lower tablet cassette 2. Accordingly, also in this embodiment, in the state where the bottom plate 23 is blocked from opening, a gap through which the tablets M unintentionally pass is less likely to be generated between the supply cell 22 and the bottom plate 23.

Note that, although not shown, the bottom plate 23 of the embodiment illustrated in FIG. 9 may be provided with the protruding portion 233 illustrated in each of the above-mentioned embodiments.

The above description is summarized. The present embodiment provides the medicine supply apparatus for dividing, into small portions, the tablets M or medicines having a dosage form similar to a tablet form and supplying the divided tablets or the medicines, the medicine supply apparatus including the tablet supplying portion 2 that temporarily houses the tablets M or the medicines. The tablet supplying portion 2 includes the tablet supplying portion body 21, the bottom plates 23, and the bottom plate supporting member 3. The tablet supplying portion body 21 includes the supply cells 22. The supply cells 22 each include the upper opening portion opened upward and the lower opening portion opened downward. The tablet housing space 22*a* is formed between the upper opening portion and the lower opening portion. The bottom plates 23 are provided so as to respectively correspond to the supply cells 22, and each include the bottom plate upper surface, the first end portion 23X, and the second end portion 23Y. The first end portion 23X of each bottom plate 23 is attached to the tablet supplying portion body 21 such that the lower opening portion is opened and closed by a pivotal movement of the second end portion 23Y of the bottom plate 23. The bottom plate supporting member 3 supports the bottom plates 23 from below to thereby make pivotal movements of the bottom plates 23 restrictable, and is relatively movable in the horizontal direction with respect to the tablet supplying portion body 21. Each bottom plate 23 pivotally moves between the state where the lower opening portion is blocked from opening and the opened state, along with the relative movement in the horizontal direction. In the state where each bottom plate 23 closes the lower opening portion, at least part of the bottom plate upper surface is located higher, whereas the lower surface 22*b* in the periphery of the lower opening portion is located lower.

According to such a configuration, in the state where each bottom plate 23 closes the lower opening portion, at least part of the bottom plate upper surface is located higher, whereas the lower surface 22*b* in the periphery of the lower opening portion is located lower. Hence, a height corresponding to an amount by which at least part of the bottom plate upper surface is located higher than the lower surface 22*b* in the periphery of the lower opening portion can serve as an absorption allowance for absorbing a positional error of the bottom plate 23 due to the gap between the bottom plate 23 and the bottom plate supporting member 3. Accordingly, in the state where the bottom plate 23 is blocked by the bottom plate supporting member 3 from opening, a gap through which the tablets M or the like unintentionally pass is less likely to be generated between the supply cell 22 and the bottom plate 23.

Further, the bottom plate 23 may include the bottom plate lower surface. The bottom plate supporting member 3 may be provided at a position spaced apart downward from the bottom plate lower surface. The distance between: the highest portion of the bottom plate upper surface in the state where the bottom plate 23 closes the lower opening portion; and the lower surface 22*b* in the periphery of the lower opening portion may be equal to or more than the distance between the bottom plate lower surface and the upper surface of the bottom plate supporting member 3 in such a closed state.

According to such a configuration, the distance between: the highest portion in the state where the bottom plate 23 closes the lower opening portion; and the lower surface 22*b* in the periphery of the lower opening portion is equal to or more than the distance between the bottom plate lower surface and the upper surface of the bottom plate supporting member 3 in such a closed state. Hence, the highest portion of the bottom plate upper surface in such a closed state is higher than or equal in height to the lower surface 22*b* in the periphery of the lower opening portion. Accordingly, in the state where the bottom plate 23 is blocked by the bottom plate supporting member 3 from opening, a gap through which the tablets M or the like unintentionally pass is less likely to be generated between the supply cell 22 and the bottom plate 23.

Further, the bottom plate 23 may include a portion located inside of the tablet housing space 22*a* in the state where the bottom plate 23 closes the lower opening portion.

According to such a configuration, the bottom plate 23 includes the portion located inside of the tablet housing space 22*a* in the state where the bottom plate 23 closes the lower opening portion. Hence, the height of the portion located inside of the tablet housing space 22*a* can serve as an absorption allowance for absorbing a positional error of the bottom plate 23 due to the gap between the bottom plate 23 and the bottom plate supporting member 3. Accordingly, in the state where the bottom plate 23 is blocked by the bottom plate supporting member 3 from opening, a gap through which the tablets M or the like unintentionally pass is less likely to be generated between the supply cell 22 and the bottom plate 23.

Further, the bottom plate 23 may include the base portion 231 and the protruding portion 233 that protrudes upward from the base portion 231. The base portion 231 may be located outside of the tablet housing space in the state where the bottom plate 23 closes the lower opening portion. The protruding portion 233 may be located inside of the tablet housing space 22*a* in such a closed state.

According to such a configuration, the protruding portion 233 is located inside of the tablet housing space 22*a* in the state where the bottom plate 23 closes the lower opening portion. Hence, a height corresponding to an amount by which the protruding portion 233 is located inside of the tablet housing space 22*a* can serve as an absorption allowance for absorbing a positional error of the bottom plate 23 due to the gap between the bottom plate 23 and the bottom plate supporting member 3. Accordingly, in the state where the bottom plate 23 is blocked by the bottom plate supporting member 3 from opening, a gap through which the tablets M or the like unintentionally pass is less likely to be generated between the supply cell 22 and the bottom plate 23.

Further, the protruding portion 233 may be provided so as to extend from the first end portion 23X to the second end portion 23Y of the bottom plate 23 in the horizontal direction.

According to such a configuration, the protruding portion 233 is located inside of the tablet housing space 22*a* so as to extend from the first end portion 23X to the second end portion 23Y. Hence, generation of a gap with the bottom plate 23 can be suppressed over the entire supply cell 22.

Further, the upper surface of the protruding portion 233 may be inclined with respect to the base portion 231 such that the amount of upward protrusion of the protruding portion 233 on the second end portion 23Y side of the bottom plate 23 in the horizontal direction is larger than the amount of upward protrusion thereof on the first end portion 23X side thereof in the horizontal direction.

According to such a configuration, even if the bottom plate 23 includes the protruding portion 233, the protruding portion 233 is less likely to be caught on the periphery of the lower opening portion of the supply cell 22 along with a pivotal movement of the bottom plate 23, and therefore the bottom plate 23 smoothly pivotally moves.

Further, the periphery of the lower opening portion of the supply cell 22 may include the inner peripheral portion 221 and the outer peripheral portion 222. The lower surface 221*a* of the inner peripheral portion may be located higher than the lower surface 222*a* of the outer peripheral portion 222. In this configuration, the bottom plate 23 may be abuttable against the lower surface 221*a* of the inner peripheral portion 221.

According to such a configuration, the bottom plate 23 can be located on the step formed by the inner peripheral portion 221 and the outer peripheral portion 222. Hence, a height corresponding to an amount by which the bottom plate upper surface is located higher by the step than the lower surface 222*a* of the outer peripheral portion can serve as an absorption allowance for absorbing a positional error of the bottom plate 23 due to the gap between the bottom plate 23 and the bottom plate supporting member 3. Accordingly, in the state where the bottom plate 23 is blocked by the bottom plate supporting member 3 from opening, a gap through which the tablets M or the like unintentionally pass is less likely to be generated between the supply cell 22 and the bottom plate 23.

As described above, according to the present embodiment, in the state where the bottom plate 23 is supported and blocked by the bottom plate supporting member 3 from opening, a gap through which the tablets M or the like unintentionally pass is less likely to be generated between the supply cell 22 and the bottom plate 23. Hence, it is possible to suppress an unintentional drop of the tablets M or the like while suppressing an increase in manufacturing costs of the medicine supply apparatus.

Hereinabove, the embodiments of the present invention have been described, but the present invention is not limited to the above-mentioned embodiments, and can be variously changed within a range not departing from the gist of the present invention.

REFERENCE SIGNS LIST

2 tablet supplying portion, lower tablet cassette
21 tablet supplying portion body, body of lower tablet cassette
22 supply cell
22*a* tablet housing space
22*b* lower surface in periphery of lower opening portion
221 inner peripheral portion
221*a* lower surface of inner peripheral portion
222 outer peripheral portion
222*a* lower surface of outer peripheral portion
23 bottom plate
23X first end portion of bottom plate
23Y second end portion of bottom plate
231 base portion of bottom plate
233 protruding portion of bottom plate
3 bottom plate supporting member, support plate
31 part of bottom plate supporting member, movable plate
M tablet

The invention claimed is:

1. A medicine supply apparatus for dividing, into small portions, tablets or medicines having a dosage form similar to a tablet form and supplying the divided tablets or the medicines, the medicine supply apparatus comprising a tablet supplying portion that temporarily houses the tablets or the medicines, wherein the tablet supplying portion includes a tablet supplying portion body, a bottom plate, and a bottom plate supporting member, the tablet supplying portion body includes a supply cell, the supply cell includes an upper opening portion opened upward and a lower opening portion opened downward, a tablet housing space is formed between the upper opening portion and the lower opening portion, the bottom plate is provided so as to correspond to the supply cell, and includes a bottom plate upper surface, a first end portion, and a second end portion, the first end portion of the bottom plate is attached to the tablet supplying portion body such that the lower opening portion is opened and closed by a pivotal movement of the second end portion of the bottom plate, the bottom plate supporting member supports the bottom plate from below to thereby make a pivotal movement of the bottom plate restrictable, and is relatively movable in a horizontal direction with respect to the tablet supplying portion body, the bottom plate pivotally moves between a state where the lower opening portion is blocked from opening and an opened state, along with the relative movement in the horizontal direction, a periphery of the lower opening portion of the supply cell includes an inner peripheral portion and an outer peripheral portion, a lower surface of the inner peripheral portion is located higher than a lower surface of the outer peripheral portion, and the bottom plate is abuttable against the lower surface of the inner peripheral portion.

2. The medicine supply apparatus according to claim 1, wherein in a state where the bottom plate closes the lower opening portion, at least part of the bottom plate upper surface is located higher, whereas a lower surface in a periphery of the lower opening portion is located lower, the bottom plate includes a bottom plate lower surface, the bottom plate supporting member is provided at a position spaced apart downward from the bottom plate lower surface, and a distance between:

a highest portion of the bottom plate upper surface in the state where the bottom plate closes the lower opening portion; and the lower surface in the periphery of the lower opening portion is equal to or more than a distance between the bottom plate lower surface and an upper surface of the bottom plate supporting member in such a closed state.

3. The medicine supply apparatus according to claim 1, wherein the bottom plate includes a portion located inside of the tablet housing space in the state where the bottom plate closes the lower opening portion.

4. The medicine supply apparatus according to claim 3, wherein the bottom plate includes a base portion and a protruding portion that protrudes upward from the base portion, the base portion is located outside of the tablet housing space in the state where the bottom plate closes the lower opening portion, and the protruding portion is located inside of the tablet housing space in such a closed state.

5. The medicine supply apparatus according to claim 4, wherein the protruding portion is provided so as to extend from the first end portion to the second end portion of the bottom plate in the horizontal direction.

6. The medicine supply apparatus according to claim 5, wherein an upper surface of the protruding portion is inclined with respect to the base portion such that an amount of upward protrusion of the protruding portion on the second end portion side of the bottom plate in the horizontal direction is larger than an amount of upward protrusion thereof on the first end portion side thereof in the horizontal direction.

* * * * *